US005829742A

United States Patent [19]

Rabindran et al.

[11] Patent Number: 5,829,742

[45] Date of Patent: Nov. 3, 1998

[54] IN-FEED MAGAZINE APPARATUS AND METHOD FOR LOADING DOCUMENTS

[75] Inventors: K. George Rabindran, Morton Grove; Michael Wisniewski, Bolingbrook; Thomas Faber, Skokie; David Fillcicchia, Schaumburg; Kenneth Guenther, Park Ridge; Joseph Kalika, Niles; Mel Kerstein, Lincolnwood; John S. O'Callaghan, Willmette, all of Ill.

[73] Assignee: Bell & Howell Postal Systems Inc., Lincolnwood, Ill.

[21] Appl. No.: 725,079

[22] Filed: Jul. 17, 1996

Related U.S. Application Data

[63] Continuation of Ser. No. 604,504, Feb. 21, 1996.

[51] Int. Cl.[6] ..... B65H 1/02

[52] U.S. Cl. ..... 271/150; 271/31.1; 271/158; 271/159

[58] Field of Search ..... 271/31.1, 150, 271/151, 158, 159; 414/788.8, 790.7, 790.3, 795.8

[56] References Cited

U.S. PATENT DOCUMENTS

| | | | |
|---|---|---|---|
| 2,161,124 | 6/1939 | Babicz | 271/159 X |
| 4,052,052 | 10/1977 | Muller | 271/150 X |
| 4,757,985 | 7/1988 | Hamant et al. | 271/31.1 |
| 4,853,063 | 8/1989 | Basgil et al. | 271/31.1 |
| 5,044,877 | 9/1991 | Constant et al. | 271/158 X |
| 5,299,797 | 4/1994 | Ricciardi | 271/150 |

FOREIGN PATENT DOCUMENTS

| | | | |
|---|---|---|---|
| 876837 | 9/1996 | United Kingdom | 271/158 |

*Primary Examiner*—Boris Milef
*Attorney, Agent, or Firm*—Sonnenschein Nath & Rosenthal

[57] ABSTRACT

An in-feed magazine apparatus for loading documents includes a magazine feed ramp having one or more document conveyor belts disposed along a bottom surface, the belts being arranged to engage the bottom boundary of the documents. The conveyer belts are configured to effect forward movement of the stack of documents toward a document shingler mechanism along a linear axis defined by forward movement of the conveyer belts. Also included is a backing plate having a lower portion disposed proximal to the conveyor belt, an upper portion disposed vertically upward from the lower portion, and a generally planar face parallel to the plane defined by the face of the documents. An upper and lower sensor sense contact with the front end of the stack of documents while a controller operatively coupled to the upper and the lower sensors determines when the front end of the stack of documents lies in a plane substantially parallel to the face of the backing plate. A jogger mechanism operatively coupled to the controller and the backing plate is configured to reciprocally displace a portion of the stack of documents approaching the backing plate such that the jogger mechanism is energized when the controller determines that the stack of documents is inclined at a forward angle relative to the backing plate where such reciprocal displacement is configured to urge the stack of documents towards a substantially parallel orientation relative to the backing plate.

13 Claims, 9 Drawing Sheets

IN-FEED MAGAZINE APPARATUS AND METHOD FOR LOADING DOCUMENTS

This is a continuation of application Ser. No. 08/604,504, filed Feb. 21, 1996.

BACKGROUND OF THE INVENTION

The present invention relates generally to document handling systems, and more specifically to a novel method and apparatus for efficiently feeding a stack of documents toward a shingling station.

It is common practice in the automated handling of documents, such as mailing envelopes and flats, to progressively feed a stack of documents in a feeder station or magazine to a shingling station and then to a singulating station. The documents are then directed from the singulating station as separated single documents to sorting stations or other processing stations or devices.

Postal requirements demand that a high volume of documents be handled in a short period of time. Typically, document handling devices are required to process thousands of documents per hour with a minimum of sorting defects and product damage. If documents cannot be fed rapidly enough to the processing stations, system throughput is reduced.

Typically, the first stage in the document handling process after the documents have be placed in a container or tray with the labels facing the same direction, is to load the stack of documents onto some form of transport mechanism, such as a conveyor belt mechanism. The transport mechanism then directs the documents toward the various separators, shinglers and sorting devices.

Known systems and methods typically require substantial human intervention and action to load the stacks of documents from the tray or container onto the document transport mechanism. The operator must gather the stack of documents and place the documents on the conveyor belt so that all of the documents are in an on-edge configuration. This must be performed while taking steps to prevent the stack from falling over. Additionally, these steps are typically performed as the conveyor belt is continuously advancing the stack of documents toward the various processing stations. This is a time-intensive process and is often the limiting factor in achieving high-speed document processing and throughput. Such steps increase document processing costs and may even cause operator injury, such as repetitive stress injuries.

The documents are typically transported to an initial processing station, such as a shingling station, prior to singulation. Shingling results in orienting either the top or bottom document in a vertical stack, or the front or lead document in an on-edge stack, so that the forward or leading edge of each successive top, bottom or front document is disposed slightly forwardly or laterally of the leading edge of the next adjacent document, preferably by a distance of approximately one inch. By shingling the stacked documents, only one document at a time will enter a nip defined by singulating belts or rollers, thereby substantially reducing the possibility that more than one document at a time will be fed simultaneously through the singulating belts or rollers. The singulating belts or rollers then transport each document in an on-edge single file manner toward other sorting and processing devices.

Known systems feeding the stack of documents towards the shingling station encounter difficulty when the stack is leaning or is oriented at an angle relative to the shingler input. Since typical shinglers divert the documents at a right angle relative to the feed transport mechanism, the face of the documents must be essentially parallel to the plane defined by the input of the shingler. Such systems often utilize complex and expensive devices to align the stack of documents in a plane parallel to the shingler input and are often failure-prone. Typically, the transport mechanism is adjusted or halted in order to fix the alignment of the stack. This is inefficient and time-consuming and decreases the throughput of the system.

Thus, a method and apparatus which significantly increases the efficiency of loading stacks of on-edge documents on a conveyor system and transports the documents so that the leading document is substantially parallel to the input of a shingling station would greatly improve the rate at which documents could be handled in a document processing system.

Accordingly, it is a object of the present invention to substantially overcome the above-described problems.

It is another object of the present invention to provide a novel in-feed magazine apparatus which allows rapid and efficient loading of documents onto a conveyor system.

It is a further object of the present invention to provide a novel in-feed magazine apparatus having a throughput of over ten thousand documents per hour.

It is also an object of the present invention to provide a novel in-feed magazine apparatus configured to urge the edges of the documents against registration surfaces.

It is still another object of the present invention to provide a novel in-feed magazine apparatus that senses when the face of the stack of documents is not parallel to the plane of a shingler input.

It is yet another object of the present invention to provide a novel in-feed magazine apparatus that automatically urges the documents toward a parallel orientation relative to the plane of a shingler input.

SUMMARY OF THE INVENTION

The disadvantages of known document handling systems are substantially overcome with the present invention by providing an in-feed magazine apparatus and method for loading documents.

An important feature of the present invention is the use of two parallel paddles which are successively repositioned on the documents feed path within a stack of documents in a non-overlapping manner and where such paddles are driven separately for purposes of maintaining the documents in a substantially vertical array. The paddles allow an operator to quickly and with a minimum of effort, load additional documents onto a moving feed conveyor belt while providing support for the forward portion of the stack of documents approaching the shingling station. This in part, allows the document throughput of the system to meet or exceed ten thousand documents per hour.

Another important feature of the present invention is a novel sensor and jogger mechanism used in conjunction with the forward paddle to urge the stack of documents into a parallel orientation relative to the input of the shingling station. If the stack of documents is leaning forwardly, the jogger reciprocally loosens and displaces the stack while the conveyor belt that engages the bottom edge of each document continues to advance the stack toward the shingling station input. This tends to urge the stack of documents toward a vertical or parallel orientation relative to the input plane of the shingler station. If the stack of documents is leaning backwardly, the forward paddle displaces the upper portion of the stack relative to the conveyor belts to vertically orient the stack. Since the documents entering the shingler station are vertically aligned, each document is fed into the shingler without jamming the shingler station. This provides an extremely high level of system throughput.

More specifically, the in-feed loading apparatus for feeding aligned stacks of documents toward a feed-roller mechanism where the stacks of documents extend successively from a front end to a back end, the documents having at least a bottom and a side boundary each defined by substantially coplanar marginal edges of the documents, includes a feed ramp having one or more document conveyor belts disposed along a bottom surface of the ramp, where the belts engage the bottom boundary of the documents. The conveyer belts are configured to effect forward movement of first and second stacks of documents toward the feed-roller mechanism along a predetermined path, where a face of each document is parallel to the face of adjacent documents and transverse to a linear axis of forward movement of the documents.

A forward paddle and a rear paddle, which is parallel to the forward paddle are included. Each paddle has a planar face transverse to the direction of movement of the first and second stacks of documents and each paddle is generally parallel to a face of the documents. A paddle transport mechanism is operatively coupled to the forward paddle to effect controllable forward motion of the forward paddle in selective linear correspondence with forward motion of the conveyor belts to urge to maintain the first stack of documents in a substantially vertical position relative to the conveyor belts. Similarly, the rear paddle is operatively coupled to the conveyor belts to effect forward motion of the rear paddle in linear correspondence with the conveyor belts such that the second stack of documents is bounded between the rear paddle and the forward paddle.

The apparatus transports documents to a feed mechanism, such as a shingler station, which is operative to impart velocity to the marginal edges of the documents in a direction substantially at right angles to the feed ramp. The apparatus includes a backing plate having a lower portion disposed proximal to the conveyor belts, an upper portion disposed vertically upward from the lower portion, and a face parallel to the plane defined by the face of the documents. An upper sensor is disposed in the upper portion of the backing plate and a lower sensor is disposed in the lower portion of the backing plate to sense contact with the front end of the stack of documents.

A controller system or module is operatively coupled to the upper sensor and the lower sensor to determine when the front end of the stack of documents lies in a plane substantially parallel to the face of the backing plate, and further determines when the face of the stack of documents is disposed at an angle relative to the backing plate.

A jogger mechanism is operatively coupled to the controller system and extends from the backing plate and is configured to reciprocally displace a portion of the stack of documents approaching the backing plate. The jogger mechanism is energized when the controller system determines that the stack of documents is inclined at a forward angle relative to the backing plate where such reciprocal displacement urges the stack of documents towards a substantially parallel orientation relative to the backing plate. The jogger mechanism maintains the efficiency of the document feed operation by keeping the bottom edge of the documents in contact with the driving surfaces of the shingling device. Further, the jogger mechanism rotates in a forward direction as it controls the lead document in the stack, thereby aiding the forward motion of the lead document as the document is advanced by the shingling device.

More specifically, the method for feeding stacks of documents towards a shingling mechanism includes the steps of: a) separating a forward and a rear paddle by a predetermined distance along a conveyor mechanism; b) placing a first stack of documents on the conveyor mechanism ahead of the forward paddle; c) placing a second stack of documents on the conveyor mechanism between the forward paddle and the rear paddle as the documents are transported in the forward direction toward the feed-roller mechanism; d) transporting the first and second stacks of documents toward the feed-roller mechanism in a forward direction along a predetermined path, the forward and rear paddles moving in linear correspondence with the documents, the first stack of documents being directed into the feed-roller mechanism, said transporting performed under control of a controller to selectively and variably control the speed of the conveyer mechanism and the forward and rear paddles; e) upwardly rotating the forward paddle about a linear axis defined by the forward motion of the documents when a predetermined portion of the first stack of documents has been directed into the feed-roller mechanism, the rotation configured to disengage the forward paddle from between the first and the second stack of documents causing the second stack of documents to merge into the first stack of documents; f) rearwardly displacing the forward paddle to a position adjacent and forward of the rear paddle; g) downwardly rotating the forward paddle such that the forward paddle is disposed between the rear paddle and the first stack of documents; h) rearwardly displacing the rear paddle to form a gap of predetermined length between the forward paddle and the rear paddle such that the forward paddle is adjacent the back end of the first stack of documents; and i) continuously repeating the steps (c) through (h).

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figure 1:
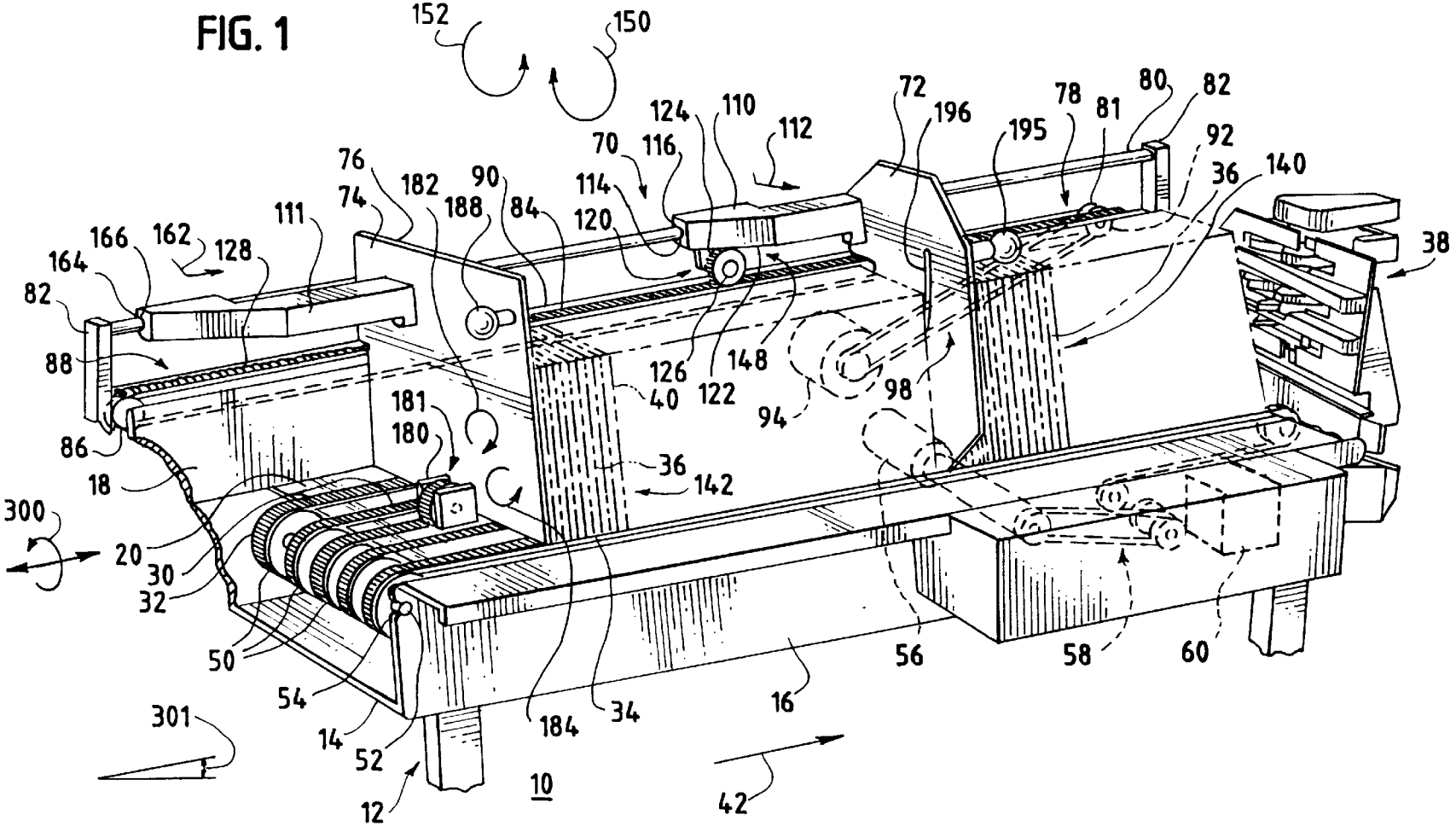
FIG. 1 is a perspective detail view of a specific embodiment of a document in-feed magazine apparatus according to the present invention.

Referring now to FIG. 1, the in-feed apparatus 10 for loading documents is shown generally. The apparatus 10 includes an in-feed magazine 12 having a frame 14, a ramp portion defining a generally inclined rectangular feed ramp 16 and a rectangular upstanding sidewall portion 18 disposed at right angles to a bottom surface 20 of the feed ramp and extending substantially along the length of the feed ramp. The generally rectangular bottom surface 20 provides a document conveying path defined by a plurality of five parallel endless toothed conveyor belts 30 spaced transversely across the bottom surface. The surfaces of the conveyor belts 30 are substantially flush with the bottom surface 20 of the feed ramp 16 and include timing notches or teeth 32 that project upwardly from the conveyor belts 30 to engage the bottom edges 34 of documents 36 placed on the feed ramp.

The apparatus 10 is configured to receive the stack of documents 36 and feed the documents to "downline" processing devices (not shown). The documents 36 may include mailing envelopes of conventional personal or commercial letter size, or "flats" which are mail pieces generally between approximately 7½ by 10½ inches and 11½ by 14½ inches along their edges, and up to approximately ¾ inches thick or more, such as magazines, catalogs, large envelopes and the like. In the illustrated embodiment, the stacked documents 36 are supported in a generally upstanding on-edge orientation and are fed along the feed ramp 16 in a forward direction while disposed generally transverse to the direction of travel.

The conveyer belts 30 are configured to effect forward movement of the stack of documents 36 toward a feed-roller mechanism 38, such as a shingler station, as will be described in greater detail hereafter. Upon reaching the shingler station 38, the stack of documents 36 is moved laterally in substantially the plane of the documents by the shingling device so as to feed the documents, in shingled fashion to the downline devices, such as singulating devices and sorting devices (not shown). A face 40 of each document 36 is generally parallel to the face of adjacent documents and transverse to a linear axis (forward axis) of forward movement of the documents, as shown by arrow 42.

Each conveyor belt 30 is supported at opposite ends of the feed ramp 16 by rollers 50 which define a continuous loop formed by the conveyor belts. Each roller 50 is fixedly supported by a transverse shaft 52 having ends supported by brackets 54 mounted in the frame 14 at opposite ends of the in-feed magazine 12. The belts 30 are rotatably driven by a conveyor belt motor 56 via a drive belt and pulley assembly 58 disposed internal to the frame 14, and diagrammatically illustrated in FIG. 1. The conveyer belt motor 56 may be, for example, a servo-motor under control of a computer control system 60, as will be described in greater detail hereinafter. When the conveyor belt motor 56 is energized, the conveyor belts 30 rotate to effect forward motion of the documents 36 disposed on the conveyor belts.

A paddle assembly 70 includes a forward paddle 72 and a rear paddle 74 disposed parallel to the forward paddle. Each paddle 72 and 74 is generally flat having a planar surface or face 76 transverse to the forward axis 42. Thus, the face 76 of each paddle is generally parallel to the face 40 of the documents 36.

Figure 2:
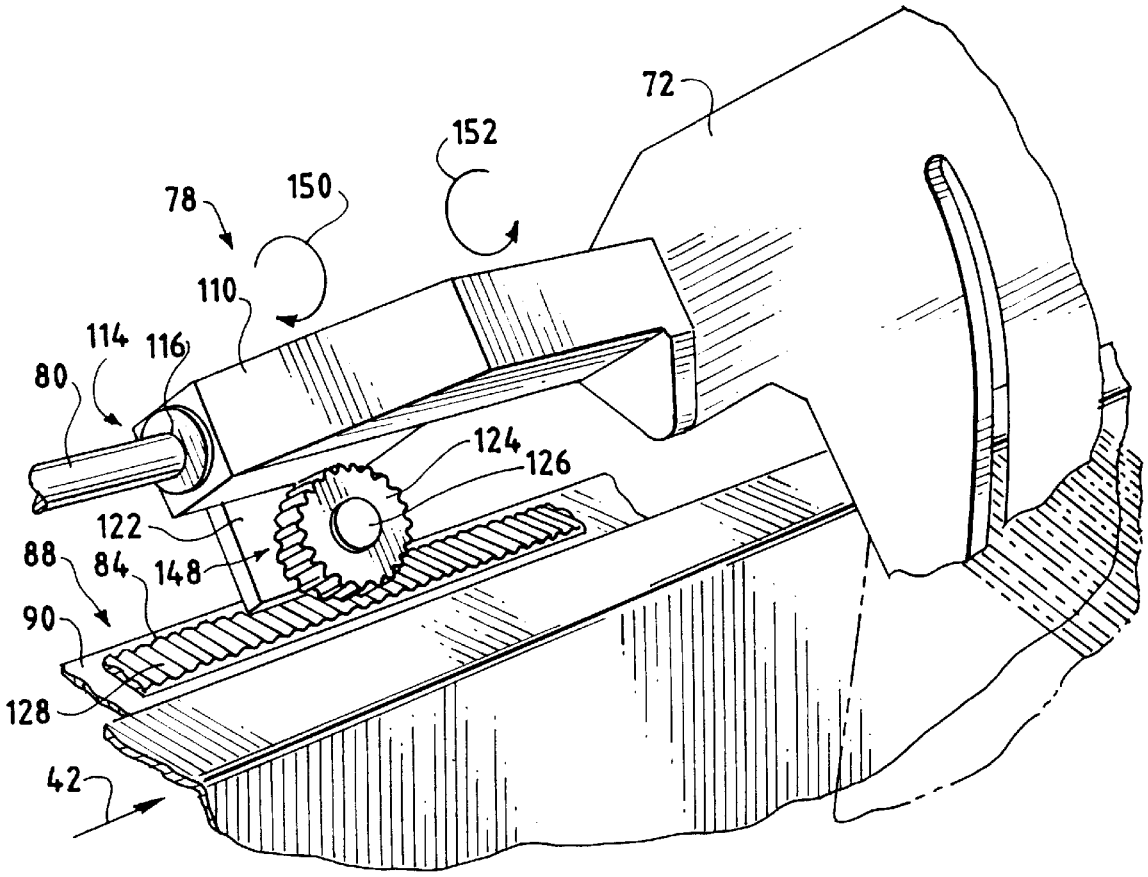
FIG. 2 is a perspective detail view of a specific embodiment of the document in-feed magazine apparatus shown in FIG. 1 particularly showing disengagement of the forward paddle from between the stacks of documents.
Figure 3A:
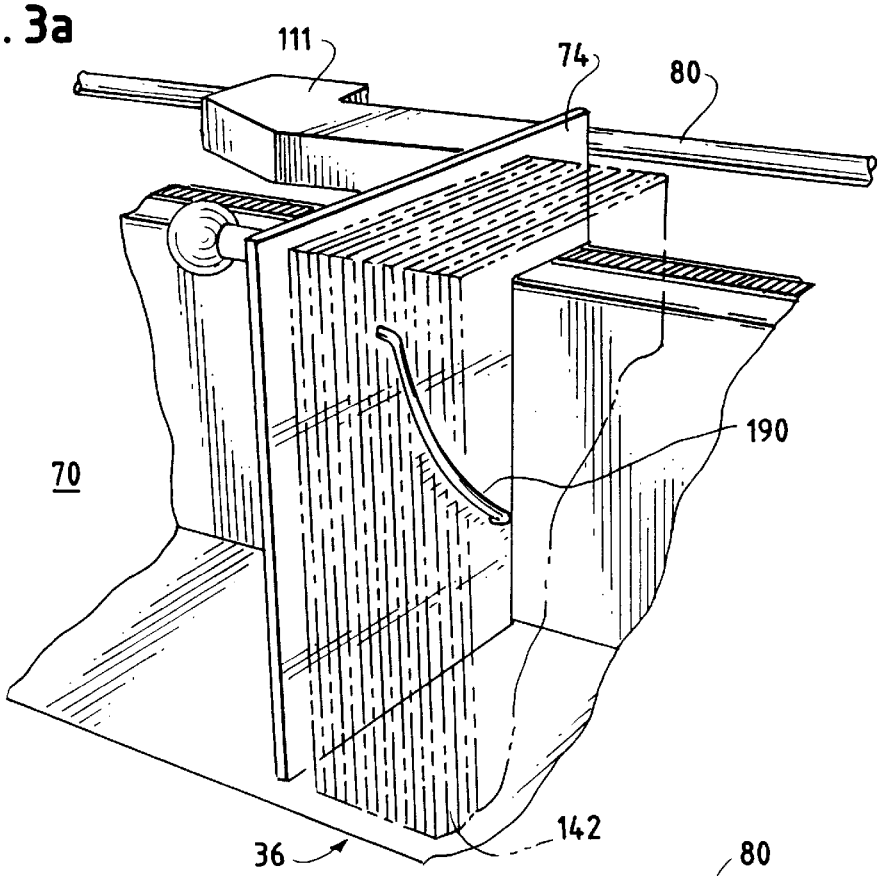
FIG. 3A is a perspective detail view of a specific embodiment of a rear paddle particularly showing a projecting spacer according to the present invention.
Figure 3B:
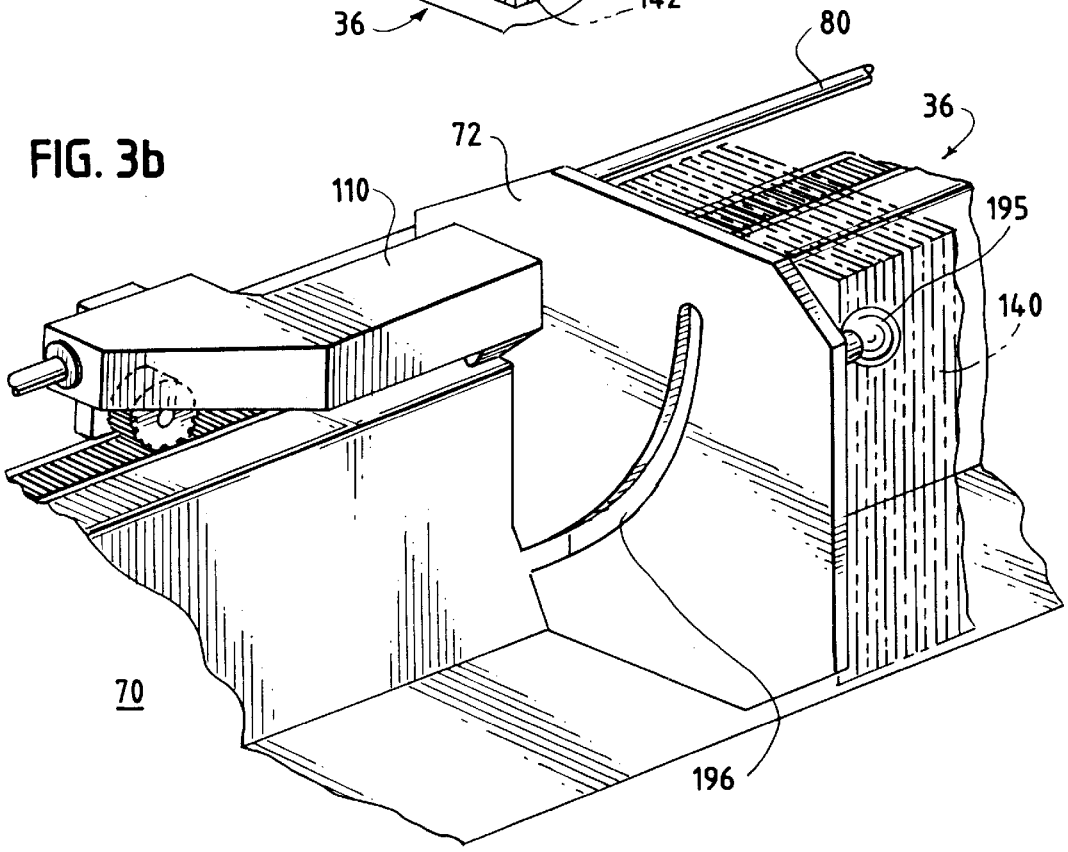
FIG. 3B is a perspective detail view of a specific embodiment of a forward paddle particularly showing a channel for engaging the projecting spacer of FIG. 3A according to the present invention.
Figure 3C:
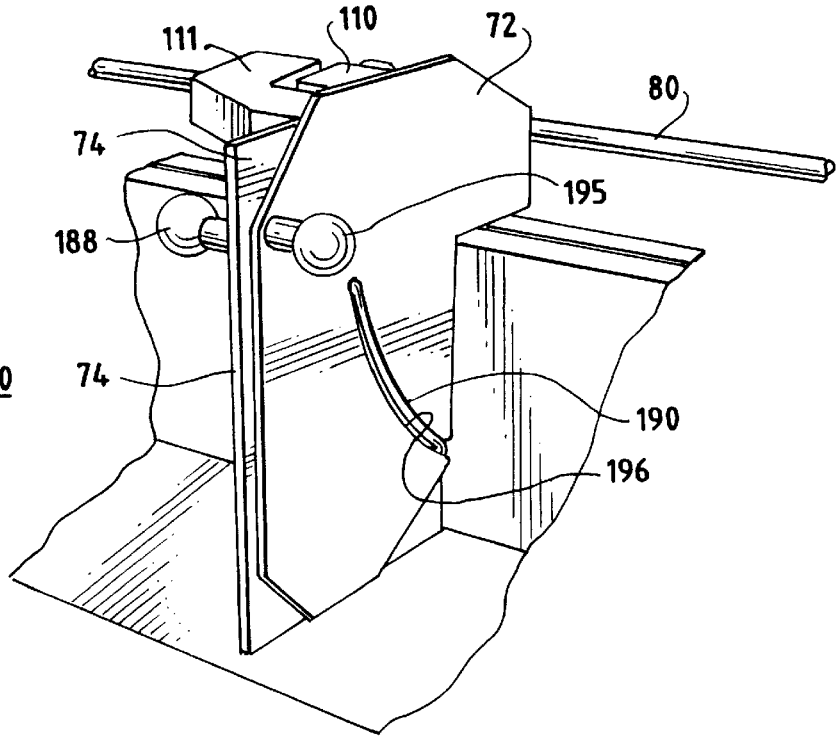
FIG. 3C is a perspective detail view of a specific embodiment of a forward paddle in operative engagement with a rear paddle according to the present invention.
Figure 3D:
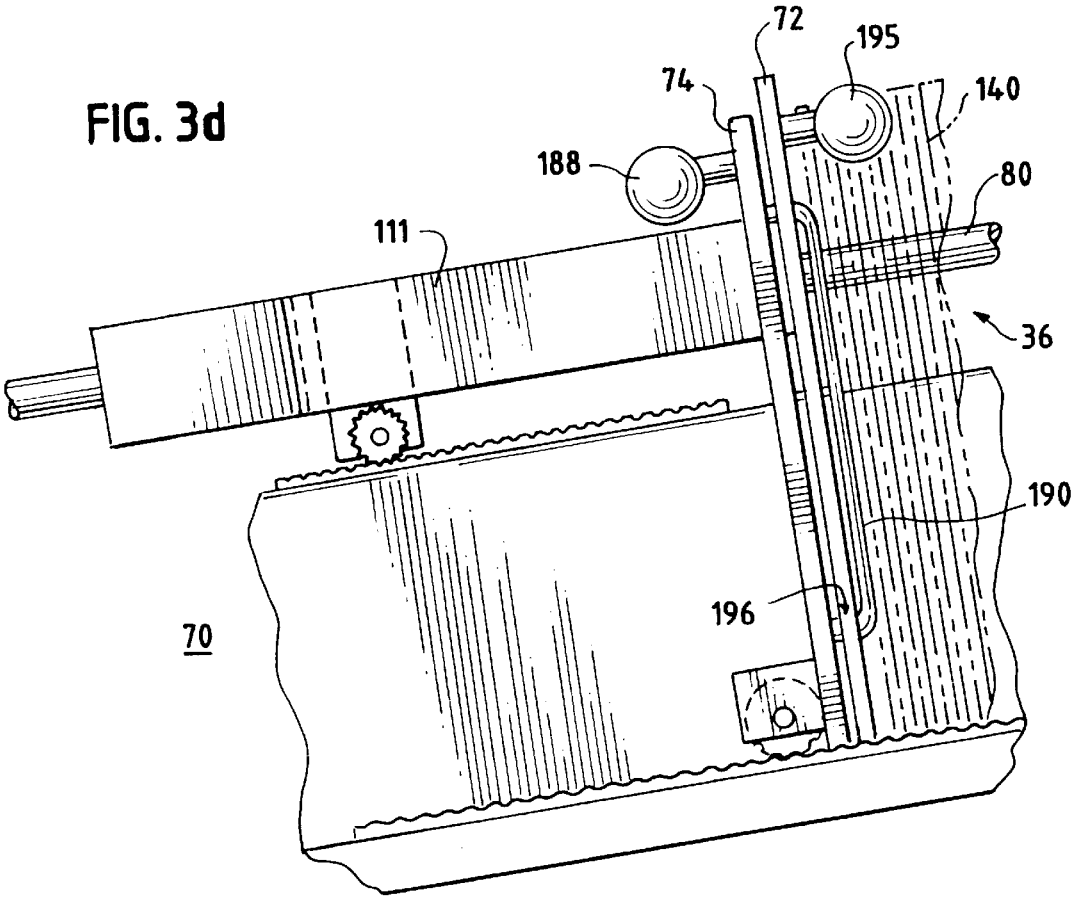
FIG. 3D is a side view of the apparatus shown in FIG. 3C.

Referring now to FIGS. 1 and 2, a paddle transport mechanism 78 includes a guide shaft 80 horizontally disposed along the length of the feed ramp 16 and fixedly mounted between two guide shaft brackets 82. Each guide shaft bracket 82 upwardly projects from the frame 14 at a position slightly leftward of the upstanding sidewall 18 to permit unimpeded linear movement of the paddles 72 and 74 along the guide shaft 80. A paddle transport belt 84 forms a continuous loop and is disposed parallel to the guide shaft 80 at a position directly below the guide shaft to effect movement of the paddles 72 and 74 along the shaft, as will be described hereinafter.

The paddle transport belt 84 is supported on opposite ends by a roller 86 disposed about a belt support mechanism 88 which provides an upper surface 90 upon which the paddle transport belt rests. The upper surface 90 is relatively smooth so that forward movement of the paddle transport belt 84 is substantially unimpeded by the friction between the upper surface 90 and the paddle transport belt. A shaft 92 projecting from the center of the forward roller 86 is coupled to a paddle transport motor 94 through a pulley and belt 98 arrangement, as is well known in the art. The paddle motor 94, may be, for example, a servo-motor under control of the computer control system 60, as will be described in greater detail hereinafter. Activation of the paddle transport motor 94 results in forward movement of the paddle transport belt 84 and hence, forward movement of the forward paddle 72.

The forward paddle 72 and the rear paddle 76 are each fixedly secured to the guide shaft 80 by extension arms 110 and 111, respectively, mounted at substantially right angles to each paddle. The extension arms 110 and 111 may be bent or angled outwardly toward the guide shaft 82, as shown by arrow 112 to facilitate linear displacement of the forward paddle 72 to a position forward of and adjacent to the rear paddle 74. The extension arm 110 includes a throughbore 114 disposed through a portion of its length through which the guide shaft 80 passes. A bushing 116 mounted within the throughbore 114 allows the extension arm 110 and attached forward paddle 72 to slide linearly relative to the guide shaft 80. The angle or outward bend 112 in the extension arm 110 permits the forward paddle 72 to slide along substantially the entire length of the feed ramp 16 without interference from the guide shaft 80 and also permits the forward paddle 72 to be positioned forward and adjacent the rear paddle 76 without the extension arms 110 and 111 of each paddle impeding movement of the paddles.

A gear mechanism 120 fixedly attached to a lower portion 122 of the extension arm 110 of the forward paddle 72 projects directly downward from the extension arm and includes a transport gear 124 rotatably mounted on a gear shaft 126. The transport gear 124 is configured to project directly downward and contact the paddle transport belt 84 disposed directly below the guide shaft 80.

As best shown in FIG. 2, the transport gear 124 selectively engages teeth or notches 128 on the paddle transport belt 84 depending upon the rotational orientation of the forward paddle 72 about the guide shaft 80. The forward paddle 72 is configured to rotate about the guide shaft 80 since the guide shaft simply rides inside of the bushings 116 affording linear and rotational displacement of the forward paddle 72. In the illustrated embodiment of FIG. 2, the forward paddle 72 is shown in an upwardly rotated position where an operator rotates the forward paddle about the guide shaft 80. Such upward rotation disengages the transport gear 124 from the paddle transport belt 84 so that movement of the paddle transport belt 84 has no effect on the linear position of the forward paddle 72. Thus, in the upwardly rotated position, the forward paddle 72 can be independently displaced along the guide shaft 80 by the operator.

Referring to FIGS. 1 and 2, when the stack of documents 36 is disposed on the conveyor belts 30 and the forward paddle 72 is in a non-rotated or downwardly rotated position, the forward paddle essentially separates the stack of documents 36 into a first or forward stack 140 and a second or rearward stack 142. Upward rotation of the forward paddle 72 about the guide shaft 80 disengages the forward paddle from between the first stack 140 and the second stack 142 of documents causing the second stack to merge into the first stack forming one large stack of documents. Since such upward rotation also disengages the transport gear 124 from the paddle transport belt 84, the forward paddle 72 may be linearly displaced along the guide shaft 80 by simple hand movement of the operator.

A one-way clutch 148 disposed within the transport gear 124 allows the transport gear to rotate in the clockwise direction (shown by arrow 150) but not in the counter-clockwise direction (shown by arrow 152). The one-way clutch 148 permits the paddle transport belt 84 to propel the forward paddle 72 in an indexed fashion relative to the transport belt since the transport gear 124 cannot rotate in the counterclockwise direction 152. Thus, forward travel of the transport belt 84 causes the forward paddle 72 to move in the forward direction regardless of the state of the conveyor belts 30. Movement of the forward paddle 72 is completely controlled by movement of the paddle transport belt 84. The controller 60 selectively synchronizes movement of the paddle transport belt 84 with the movement of the conveyor belts 30 and corresponding documents 36.

The rear paddle 74 is attached to the paddle transport mechanism 78 in a similar manner as attachment of the forward paddle 72 except that no transport belt coupling exists. The rear paddle 74 is fixedly secured to the guide shaft 80 by the extension arm 111 mounted at substantially right angles to the rear paddle. The extension arm 111 may also be bent or angled outwardly toward the guide shaft 82, as shown by arrow 162. The extension arm 111 also includes a throughbore 164 disposed through a portion of its length through which the guide shaft 80 passes. A bushing 166 mounted within the throughbore 164 allows the extension arm 111 and the attached rear paddle 74 to slide linearly relative to the guide shaft 80.

The angle or outward bend 162 in the extension arm 111 permits the rear paddle 74 to slide along substantially the entire length of the feed ramp 16 without interference from the guide shaft 80 or the forward paddle 72. The rear paddle 74 is similarly upwardly rotatably about the guide shaft 80 and linearly displaceable therealong. Note that the bend 162 in the rear paddle extension arm 111 is more pronounced than the bend 112 in the forward paddle extension arm 110 to allow the forward paddle 72 to be placed adjacent the rear paddle 74 without interference between the extension arms 110 and 111.

The rear paddle 74 does not engage the forward paddle transport belt 84, but rather, is propelled in the forward direction 42 solely through engagement with the conveyor belts 30. A rear paddle gear 180 disposed at the bottom of the rear paddle 74 engages the teeth 32 of the conveyer belts 30. Such engagement propels the rear paddle 74 along with the conveyor belts 30. A one-way clutch 181 disposed within the rear paddle gear 180 allows the gear to rotate in the clockwise direction (shown by arrow 182) but not in the counter-clockwise direction (shown by arrow 184). This permits the rear paddle 74 to move in an indexed fashion along with the conveyor belts 30 in the forward direction 42 while allowing the operator to linearly displace the rear paddle in the forward direction relative to the conveyor belts 30 without disengaging the rear paddle gear 180 from the conveyor belts 30. To linearly displace the rear paddle 74 in the backward direction, the operator rotates the rear paddle upward to disengage to rear paddle gear 180 from the conveyer belts 30 and slides the rear paddle backwards while the conveyor belts are in motion.

Referring now to FIGS. 1 and 3A–3D, the rear paddle 74 includes a handle 188 rearwardly projecting from its rear surface and a spacer 190 projecting from its front surface. The spacer 190 separates the second or rear stack of documents 142 from the rear paddle 74 by a predetermined distance for example, by about ¼ to ½ of an inch. The spacer 190 may, for example, be a metal wire standoff shaped in the form of an arc. Alternatively, a plurality of upstanding studs may be used. When the second stack of documents 142 is disposed adjacent the rear paddle 74, the spacer 190 provides a gap therebetween so that a small space exists between the second stack of documents 142 and the surface of the rear paddle. The spacer 190 is shaped in the form of an arc, the locus of which corresponds to the circumference of an imaginary circle having a center located at the guide shaft 80.

The forward paddle 72 includes a handle 195 and a channel 196 configured to engage the spacer 190 during rotation of the forward paddle about the guide shaft 80 and subsequent adjacent engagement. The channel 196 is formed through the entire thickness of the front paddle 74 and extends along an arc corresponding to the arc defined by the spacer 190. The channel 196 and the spacer 190 are used to position the forward paddle 72 between the rear paddle 74 and the second stack of documents 142 without physically moving the second stack of documents away from the rear paddle. Thus, rotation of the forward paddle 72 about the guide shaft 80 allows the channel 196 to operatively engage the similarly shaped spacer 190 during rotation of the forward paddle when the two paddles 72 and 74 are adjacently positioned.

When the second stack of documents 142 is bounded between the rear paddle 74 and the forward paddle 72, the forward paddle may be rotated upwardly and then backwardly displaced along the guide shaft 80. When the forward paddle 72 is linearly positioned adjacent and just forward of the rear paddle 74, it is then downwardly rotated so that the channel 196 engages the spacer 190. This allows the forward paddle 72 to essentially "slip" into position between the rear paddle 74 and the second stack of documents 142. By placing the forward paddle 72 behind the second stack of documents 142, but just forward of the rear paddle 74, the second stack of documents 142 essentially merges into the first stack of documents 140 which are then advanced along the conveyor belts 30 toward the feed-roller mechanism 38.

The ability to non-overlapingly reposition the forward paddle 72 and rear paddle 74 along the length of the feed ramp 16 allows the operator to continuously add documents to the feed ramp to create the second stack of documents 142 and add documents 36 thereto while the documents continuously advance toward the feed-roller mechanism 38. Such non-overlapping repositioning allows rapid and efficient delivery of documents to the feed ramp 16.

Figure 4A:
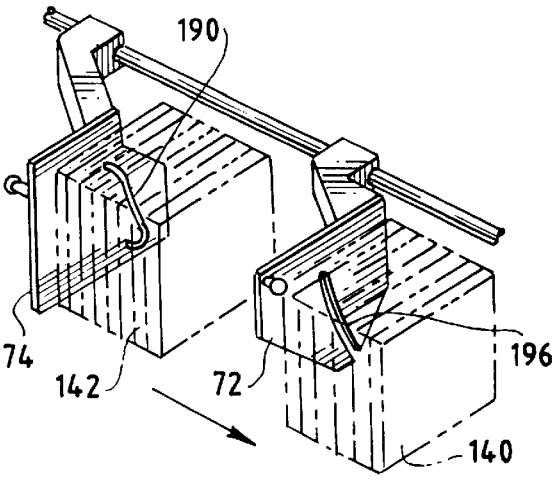
FIGS. 4A–4E are perspective views of a specific embodiment depicting an operational sequence of loading documents.
Figure 4B:
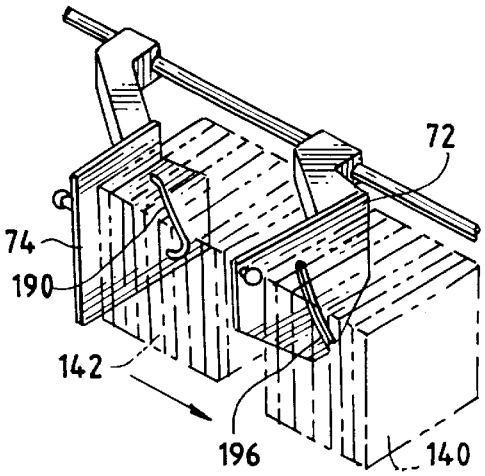
Figure 4C:
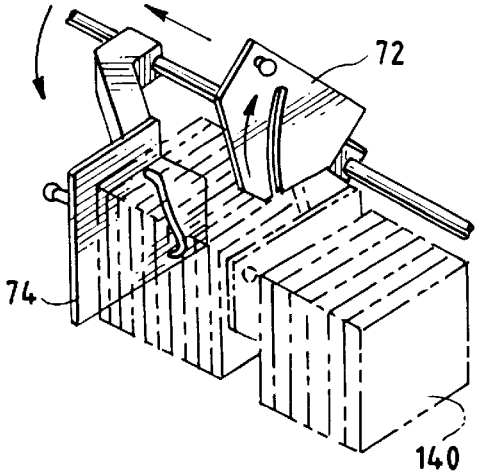
Figure 4D:
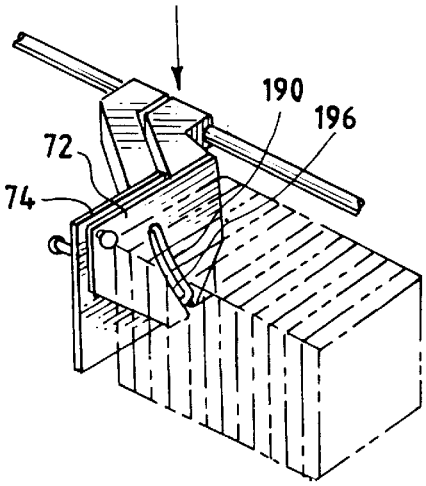
Figure 4E:
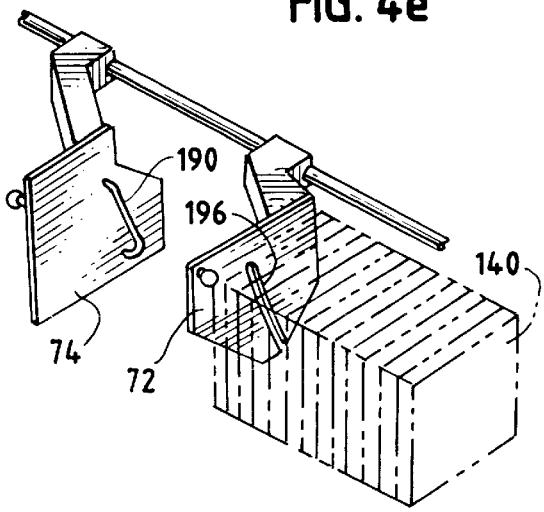
Figure 5A:
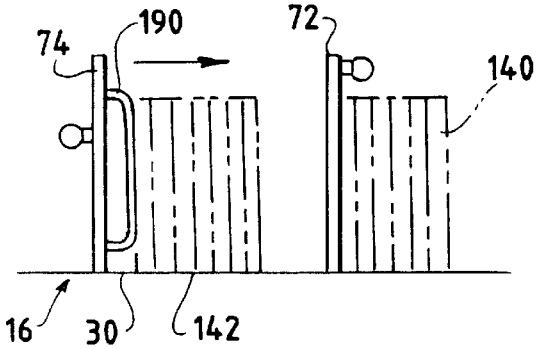
FIGS. 5A–5E are side elevational views of the operational sequence shown in FIGS. 4A–4E, respectively, where each figure in FIGS. 5A–5E corresponds to a figure in FIGS. 4A–4E.
Figure 5B:
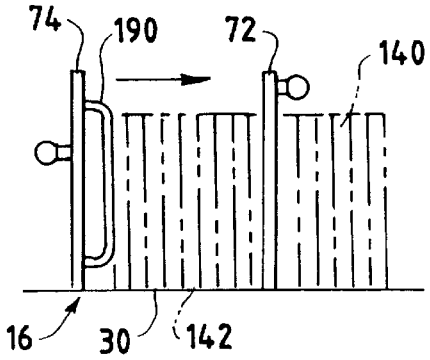

Referring now to FIGS. 1, 4A–4E and 5A–5E, the operation of the forward paddle 72 and the rear paddle 74 are pictorially illustrated in FIGS. 4A–4E and corresponding side views of FIGS. 5A–5E. First, the forward paddle 72 and the rear paddle 74 are separated by a predetermined distance along the feed ramp 16. This allows the first stack of documents 140 to be placed forward of the forward paddle 72 and the second stack of documents 142 to be placed forward of the rear paddle 74. Thus, the second stack of documents 142 is bounded between the forward paddle and the rear paddle, as illustrated in FIGS. 4A and 5A as the first stack of documents 140 is advanced toward the feed-roller mechanism 38. Once the first and second stacks of documents 140 and 142 have been loaded onto the feed ramp 16, the operator slides the rear paddle 74 forward to eliminate any space between the second stack of documents 142 and the forward paddle 72, as illustrated in FIGS. 4B and 5B.

Once loaded, the first stack of documents 140 and the second stack of documents 142 are advanced along the conveyor belts 30 toward the feed-roller mechanism 38 where the first stack of documents is processed. For example, the feed-roller mechanism 38 may be a shingling device which removes the lead documents from the first stack 140 of documents. Both stacks of documents 140 and 142 are simultaneously advanced toward the feed-roller mechanism 38 in the forward direction 42 along the predetermined path defined by the conveyor belts 30. The forward paddle 72 and the rear paddle 74 move in linear correspondence with the documents 36 as the first stack of documents 140 are directed into the feed-roller mechanism 38.

Figure 5C:
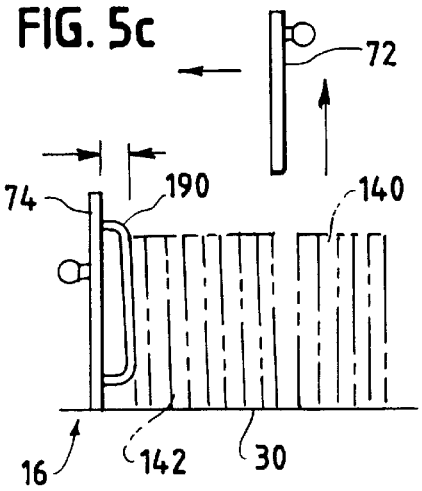

As the documents from the first stack 140 are fed into the feed-roller mechanism 38, the size of the stack decreases. When the size of the first stack of documents 140 has been reduced by a predetermined amount, for example, by 80% of its original size, the operator upwardly rotates the forward paddle 72 about the guide shaft 80 to disengage the forward paddle from between the first and second stack of documents 140 and 142. This causes the second stack of documents 142 to merge into the first stack of documents 140 to form a single larger first stack of documents, as illustrated in FIGS. 4C and 5C.

Figure 5D:
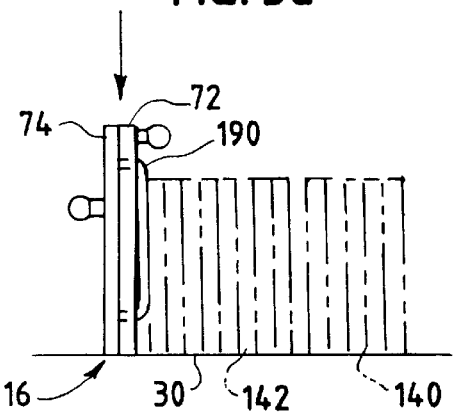

Next, while the forward paddle 72 is in the upwardly rotated position, the operator rearwardly displaces the forward paddle to a position adjacent and just forward of the rear paddle 74 and then downwardly rotates the forward paddle such that the forward paddle is disposed between the rear paddle and the documents 36, as illustrated in FIGS. 4D and 5D. In this position, the channel 196 in the forward paddle 72 engages the spacer 190 in the rear paddle 74 and allows the two paddles to be adjacent without physically dislodging any of the documents in the stack.

Figure 5E:
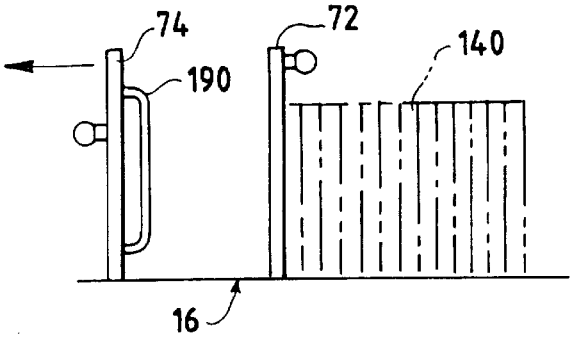
Figure 6:
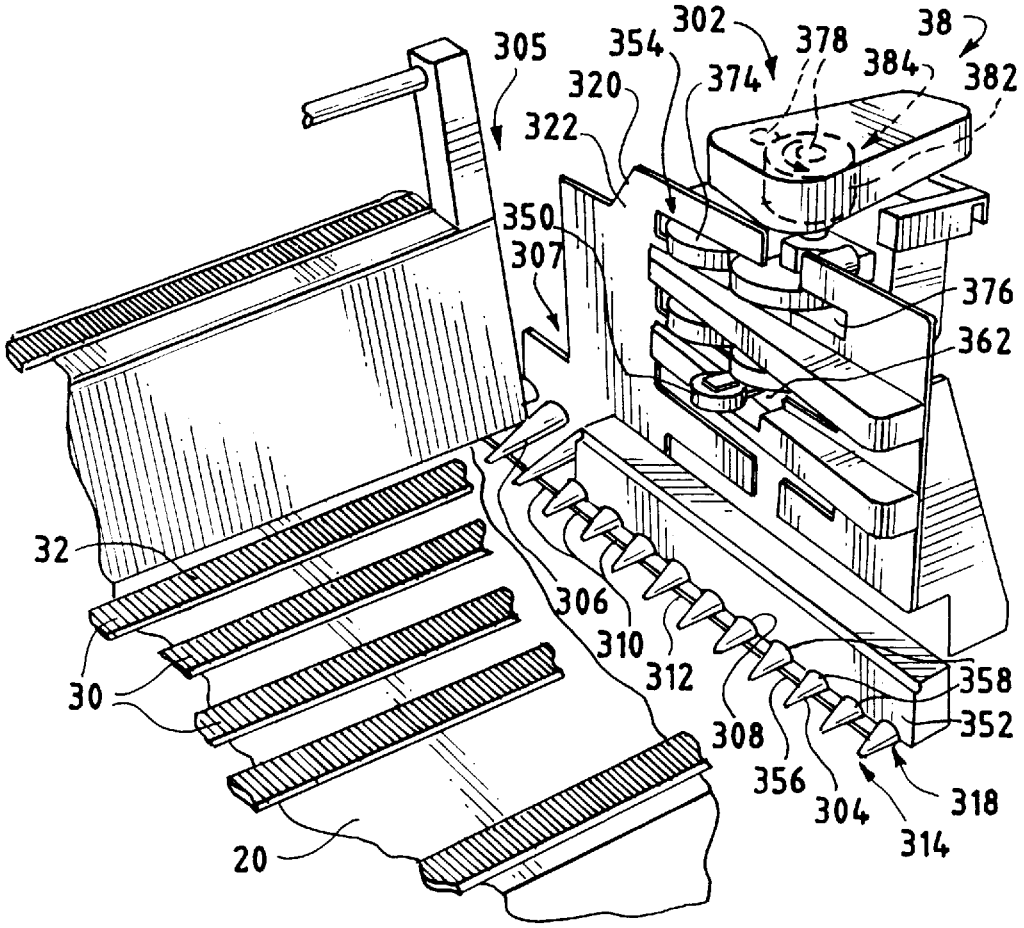
FIG. 6 is a perspective view of a specific embodiment of a document shingler and jogger portion according to the present invention.

At this point, the operator rearwardly displaces the rear paddle 74, to form a gap of predetermined length between the forward paddle 72 and the rear paddle 74 leaving the forward paddle adjacent the back end of the first stack of documents 140, as illustrated in FIGS. 4E and 5E. The operator then repeats the process by placing additional documents between the forward paddle 72 and the rear paddle 74, thus forming the second stack of documents 142. The above-described operation occurs continuously as the conveyor belts 30 advance the first stack 140 and the second stack 142 of documents toward the feed-roller mechanism 38 so that the feed-roller mechanism receives a continuous supply of documents.

Referring now to FIGS. 1, 6 and 7A–7C, the in-feed magazine 12 may be rotated about a tilt axis, as shown by arrow 300. The tilt axis 300 is coplanar with the forward axis 42 and coaxial along the intersection of the bottom surface 20 of the feed ramp 16 and the upstanding sidewall 18. Tilting the in-feed magazine 12 effectively tilts the plane of the conveyor belts 30, the bottom surface 20 and the upstanding sidewall 18 affixed thereto. Tilting the in-feed magazine 12 by about between five and fifteen degrees effectively urges the side boundaries of the stack of documents 36 against the sidewall 18 to facilitate registration of the documents thereagainst. The feed ramp 16 is also slightly inclined for example, by about eight degrees, as shown by arrow 301, so that the documents 36 rest against the face of the paddles 72 and 74. Documents 36 which have edges in alignment with a common boundary are less likely to become jammed or otherwise become misdirected within the apparatus 10.

As described above, the feed-roller mechanism 38 may, for example, be a shingler device 302 which preferably includes between five to twenty conically shaped rollers 304 disposed toward the forward end of the feed ramp 16, which defines the mouth or input 305 of the feed-roller mechanism. However, any suitable number of conical rollers 304 may be used. Each conical roller 304 rotates about a shaft 306 and each shaft is operatively coupled to a conical roller motor 307 which controls the rotational speed of the conical rollers. Alternately, multiple conical roller motors 307 may be used to control individual conical rollers 304 or selected groups of rollers such that individual groups of five rollers, for example, may be rotated at a different rate relative to adjacent groups of rollers. The conical roller motor 307 may be, for example, a servo-motor under control of the computer control system 60, as will be described in greater detail hereinafter.

Each shaft 306 is disposed below the level of the bottom surface 20 of the feed ramp 16 and is tilted relative to the plane of the bottom surface 20 so that a rotating surface portion 308 of each conical roller 304 is essentially parallel to the plane of the bottom surface. A guide plate 310 partially covers the conical rollers 304 and allows the rotating surface 308 of each conical roller to be exposed. The guide plate 310 may be formed, for example, from a plurality of triangular metal or plastic plates which are positioned and secured between adjacent conical rollers.

Alternatively, guide plate 310 may be a planar sheet of metal or plastic having cut-out triangular portions 312 that expose the rotating surfaces 308 of each conical roller 304. Accordingly, the rotating surfaces 308 of each conical roller 304 must project slightly above the plane of the guide plate 310 such that the lower marginal edges of the documents 36 contact the rotating surfaces as the documents 36 move forward.

The feed ramp 16 may be slightly elevated relative to the guide plate 310 such that the level of the conveyor belts 30 are slightly above the level of the conical rollers 304. Documents 36 exiting the feed ramp 16 are carried downward by the notches or the teeth 32 of the conveyor belts 30 as the documents reach the forward end of the conveyor belts. The documents 36 are carried downwardly a slight distance, for example, one inch, prior to contacting the guide plate 310 and the feed rollers 304. All documents 36 reaching the end of the feed ramp 16 are carried onto the guide plate 310 which partially covers the conical rollers 304 and provides a substantially smooth transitional surface along the conical rollers.

Since each conical roller 304 is disposed having its axis of rotation parallel to the length of the feed ramp 16, the surface 308 of each conical roller 304 rotates tangentially relative to the direction in which the documents 36 travel along the feed ramp 16. Each conical roller 304 has a proximal end 314, or the end having the smallest diameter disposed closest to the forward portion 316 of the feed ramp 16. The diameter of each conical roller 304 increases from the proximal end 314 toward a distal end 318 of each conical roller. Thus, the speed of the rotating surface 308 presented to the lower marginal edges of the documents 36 contacting the conical rollers 304 increases as the documents are fed into the shingler 302.

As the lower marginal edges of the documents 36 engage the rotating conical surfaces 308, the documents traverse the conical drive surfaces along a relatively linear or straight path from the proximal end 314 to the distal end 318 of the conical rollers 304 with the lower marginal edges of the document in substantially point contact with the rotating conical drive surfaces. As each successive document 36 traverses the conical drive surfaces 308, the conical rollers 304 impart velocity components of varying magnitude to the lower marginal edges of the documents 36 and effect movement of successive documents into a shingled array.

The conical drive surfaces 308 impart a velocity vector or force component of progressively increasing magnitude to the lower edge of each successive document 36 as these documents are pushed forward onto the conical drive surfaces by the conveyor belts 30. Such progressively increasing velocity or force components lie substantially in the plane of the documents 36 and impart lateral movement to each document in a plane substantially transverse to the conveyor belts 30. This causes the documents 36 to be moved laterally out of the stack at progressively increasing velocities as they advance farther from the apexes of the conical rollers 304.

This produces differential lateral movement between successive documents 36 which cause the lateral lead edges of the documents to be shingled relative to each other. Such a shingling device 302 is described in greater detail in a patent application entitled "A Method and Apparatus For Shingling Documents" filed on Jan. 3, 1994 having a Ser. No. of 08/176,966, now U.S. Pat. No. 5,494,276, in the name of Farber et al. and assigned to Bell & Howell Company, the same assignee to which the present patent/patent application is/will be assigned.

An upstanding backing plate 320 is disposed in a plane substantially parallel to the plane of the face 40 of the documents 36 and has a face portion 322 parallel thereto. The documents 36 may be inclined at about an eight degree angle relative to the backing plate 320 since the feed ramp 16 and conveyor belts 30 may be inclined at an eight degree angle, as previously described. The backing plate 320 is disposed transverse to the direction of travel 42 of the conveyor belts 30 and is set back toward the distal end 318 of the conical rollers 304 and partially overlaps the guide plate 310. The backing plate presents a "stop", or a barrier beyond which documents 36 cannot pass. Thus, documents 36 approaching the backing plate 320 in a plane substantially parallel to the face 322 of the backing plate are imparted with transverse velocity by the rotating conical rollers 304 as the documents travel across the guide plate 310 and contact the rotating surfaces 308.

Figure 7A:
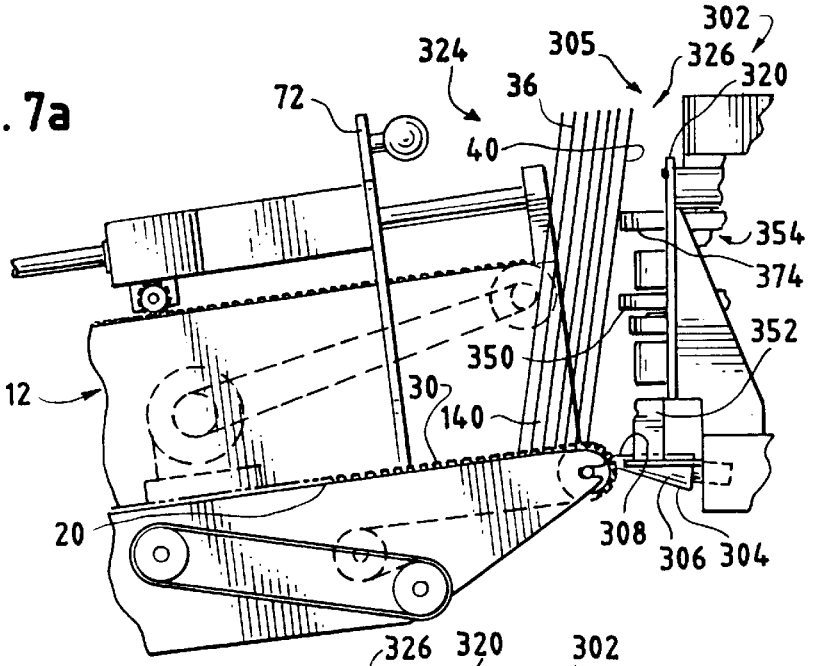
FIG. 7A is a side elevational view of the document shingler and jogger portion of FIG. 6 showing forwardly leaning documents.

Preferably, the documents 36 approaching the backing plate 320 are substantially parallel to the face 322 of the backing plate. However, the forward paddle 72 supports only a rearward portion 324 of the first stack of documents 140 and does not provide support for a forward portion 326 of the first stack of documents. Thus, the first stack of documents 140 may have documents that are leaning forward relative to the face 322 of the backing plate 320, as illustrated in FIG. 7A.

Figure 7B:
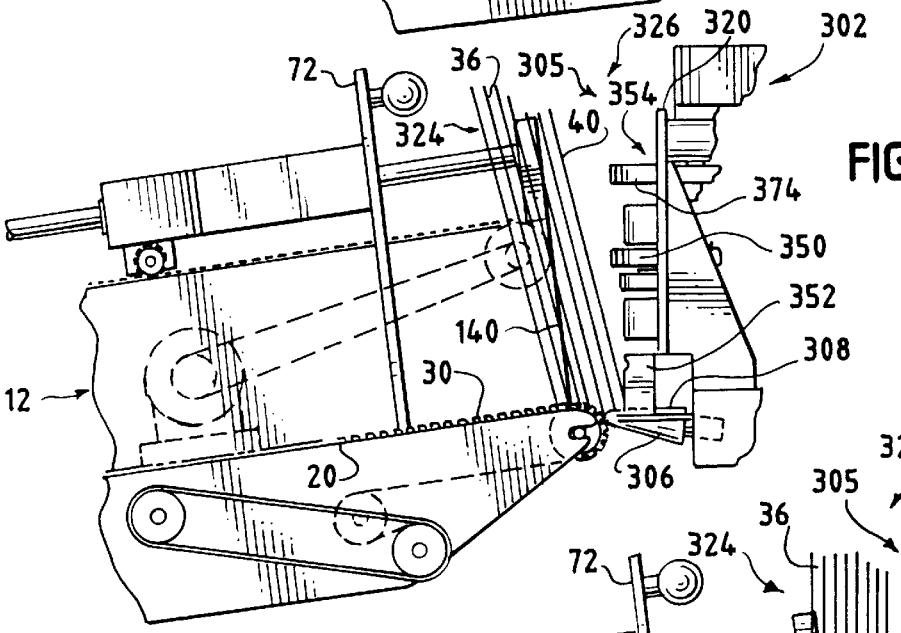
FIG. 7B is a side elevational view of the document shingler and jogger portion of FIG. 6 showing rearwardly leaning documents.
Figure 7C:
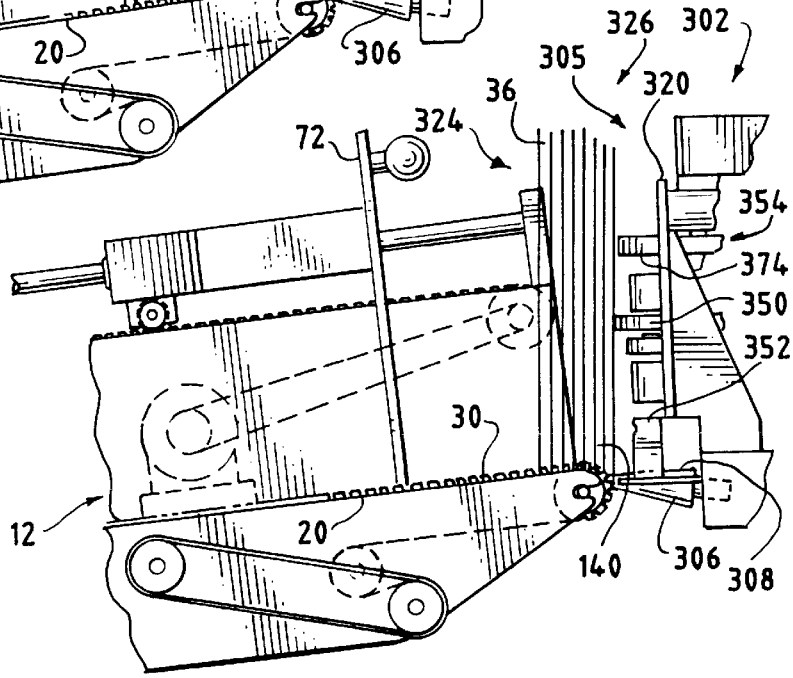
FIG. 7C is a side elevational view of the document shingler and jogger portion of FIG. 6 showing documents in a parallel orientation.
Figure 8:
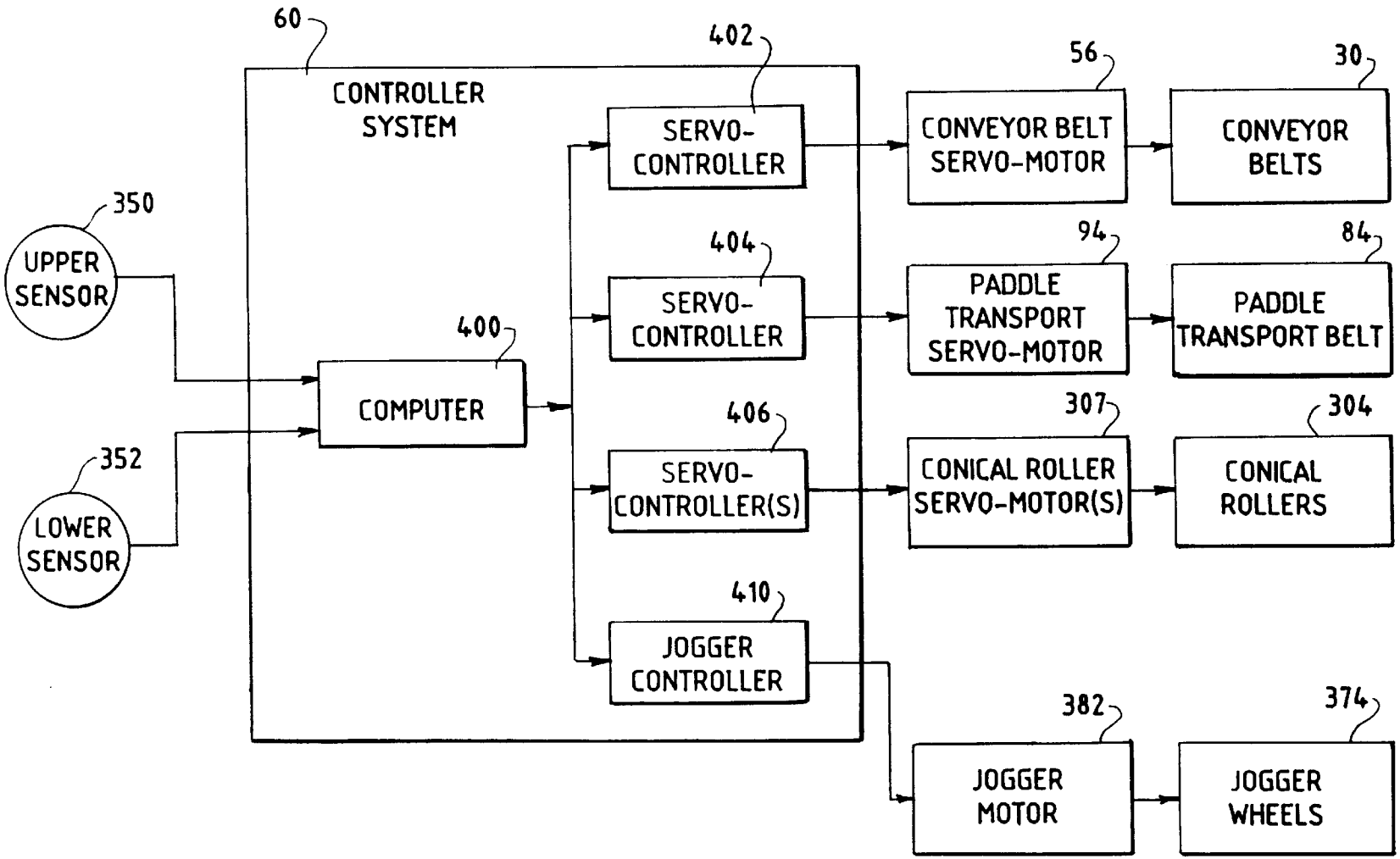
FIG. 8 is a pictorial block diagram of a controller system for controlling the apparatus of FIG. 1, according to the present invention.

Conversely, the documents may be leaning backward relative to the face 322 of the backing plate 320, as illustrated in FIG. 7B. Ideally, the documents 36 are substantially parallel to the face 322 of the backing plate 320, as illustrated in FIG. 7C.

To urge the documents 36 toward a substantially parallel orientation relative to the face 322 of the backing plate 320, an upper sensor 350, a lower sensor 352, and a jogger mechanism 354 are used in conjunction with control of the forward paddle 72 and the conveyor belts 30 provided by the controller 60. The lower sensor 352 is disposed toward a lower portion of the backing plate 320 such that a bottom portion 356 of the lower sensor slidingly contacts the guide plate 310 and rides over the distal end 318 of the conical rollers 304.

The lower sensor 352 is constructed as a substantially rectangular bar disposed parallel to the backing plate 320 between the face 322 of the backing plate and the distal end 318 of the conical rollers 304. The lower sensor 352 overlaps a portion of the distal end 318 of the conical rollers 304 but does not make contact therewith. Semicircular arches 358 or "cut-outs" disposed in the bottom portion 356 of the lower sensor 352 prevent contact between the bottom portion of the lower sensor and the distal end 318 of the conical rollers 304.

Documents 36 traveling across the guide plate 310 and over the conical rollers 304 contact the lower sensor 352 before they are imparted with transverse velocity by the conical rollers since rotation of the conical rollers is controlled by the controller 60, as will be described hereinafter. Such contact causes the lower sensor 352 to be transversely displaced toward the backing plate 320 since the lower sensor is spring mounted. A set of springs (not shown) allows the lower sensor 352 to be reciprocally displaced relative to the backing plate 320. However, any mechanism allowing reciprocal displacement of the lower sensor 352 may be used. As the lower sensor 352 is displaced in the forward direction toward the backing plate 320 by the documents 36, a circuit is activated indicating to the controller 60 that a document 36 has contacted the lower sensor.

The upper sensor 350 is disposed vertically upward from the lower sensor 352 and transversely projects from a slot or aperture 362 in the face 322 of the backing plate 320. The upper sensor 350 may be configured as a wheel that is transversely displaced when contacted by a document 36. A spring 370 similarly allows the upper sensor 350 to be reciprocally displaced relative to the backing plate 320. However, any mechanism allowing reciprocal displacement of the upper sensor 350 may be used. The minimum and maximum allowable reciprocal displacement of the upper sensor 350 and the lower sensor 352 are substantially equal so that the edges of the sensors form an imaginary plane essentially parallel to and spaced apart from the backing plate 320. This allows the controller 60 to determine when the documents 36 are parallel to the backing plate 320.

To provide precise control of the conveyor belt motor 56, the paddle transport motor 94 and the conical roller motor 307, each motor may be, for example, a servo-motor under control of the controller 60, as is well known in the art. The jogger mechanism 354 is operatively coupled to the backing plate 320 and includes four wheels 374 partially projecting through slots 376 in the backing plate. The wheels 374 are disposed vertically upward from the upper sensor 350 and contact the documents 36 at a point toward the upper reaches of the documents. Each pair of wheels 374 has a vertically disposed drive shaft 378 passing through an "off-center" aperture in each wheel forming an eccentric cam arrangement. When the drive shaft 378 rotates, the wheels 374 rotate eccentrically about the drive shaft causing the surface of the wheels to be transversely and reciprocally displaced relative to the backing plate 320.

When the jogger mechanism 354 is activated, any documents 36 in proximity with the wheels 374 are essentially "jogged" or "bumped" or repeatedly and reciprocally displaced relative to the backing plate 320. This causes forwardly leaning documents 36 to be backwardly displaced to become vertically aligned so that they are substantially parallel to the backing plate 320. Such reciprocal displacement of the documents 36 urges the first stack of documents 140 toward a substantially parallel orientation relative to the backing plate 320. However, the wheels 374 need not be configured as an eccentric cam arrangement and may be, for example, linear actuators that traverse a linear path.

Each drive shaft 378 is coupled to a jogger motor 382 through a belt and pulley arrangement 384, as is well known in the art. The jogger motor 382 is operatively coupled to the controller 60 so that it is activated by the controller depending upon the condition of the upper sensor 350 and the lower sensor 352.

Referring now to FIGS. 1, 6, 7A–7C and 8, FIG. 8 illustrates a specific embodiment of a block diagram of the controller 60. The controller 60 is disposed within the frame 14 and is operatively coupled to the upper sensor 350 and the lower sensor 352 and receives input signals from the sensors. The controller 60 includes a computer 400 which may be, for example, a microprocessor, a microcontroller, a discrete processor or any other suitable control device, as is well known in the art. Not shown are various memory circuits such as RAM and ROM and input/output circuits which are integral to such computer devices. The controller 60 may be disposed anywhere on or near the apparatus 10 and may be remotely connected to the apparatus by lengths of wires.

The controller 60 includes first, second and third servo-motor control circuits 402, 404 and 406. The first servo-motor control circuit 402 controls the conveyor motor 56 which in turn, controls the conveyor belts 30. The second servo-motor control circuit 404 controls the paddle transport motor 94 which in turn, controls the paddle transport belt 84. The third servo-motor control circuit 406 controls the conical roller motor 307 which in turn, controls the conical rollers 304. The third servo-motor control circuit 406 may be duplicated multiple times depending upon the number of conical roller motors 307 that exist since the conical rollers 304 may be individually controlled or may be controlled according to predetermined groups. For example, if twenty conical rollers 304 are divided into four groups of five conical rollers, then four servo-motor control circuits 406 are used such that all five conical rollers in the group operate at the same speed.

Servo-motors, such as the conveyor motor 56, the paddle transport motor 94 and the conical roller motor(s) 307 are used due to the inherent ease and precision in which they may be controlled. The speed of each motor 56, 94 and 307 is easily and efficiently controlled from a minimum speed, for example, zero inches per second, to a maximum speed, for example, sixty inches per second.

A jogger motor control circuit 410 controls the jogger motor 382 and need not be a servo-motor control circuit, since the jogger motor is operated at a constant speed and is either activated or deactivated. However, a servo-motor circuit may be used to control such a motor even if variable speed control is not required, depending upon the availability of such circuits in the controller module 60.

The sensors 350 and 352 allow the controller 60 to determine when the documents 36 lie in a plane substantially parallel to the face 322 of the backing plate 320. The controller 60 also determines when the documents 36 are disposed at an angle relative to the backing plate 320 by inspecting the state of the upper sensor 350 and the lower sensor 350.

In operation, if the stack of documents 36 has not yet reached the document shingler device 38, the upper sensor 350 and, the lower sensor 350 are not contacted. During this condition, the controller 60 deactivates the conical roller motors 307 so that they do not rotate. To advance the stack of documents 36 forward, the conveyor belt motor 56 and the paddle transport motor 94 are both operated at their maximum forward speed and are synchronized relative to each other to operate at identical speeds.

The controller 60 determines that the stack of documents 36 is inclined at a forward angle relative to the backing plate 320 when the upper sensor 350 senses contact with the stack of documents while the lower sensor 352 does not sense contact, as illustrated in FIG. 7A. To urge the first stack of documents 140 toward a substantially vertical position, the controller 60 directs the first servo-motor control circuit 402 to activate the conveyor belts 30. This causes the bottom of the stack of documents 36 to move forward by a predetermined distance. Simultaneously, the controller 60 directs the jogger motor control circuit 410 to activate the jogger mechanism 354 while the paddle transport belt 84 and hence, the forward paddle 72 are stationary. This moves the bottom of the documents 36 toward the lower sensor 352 as the eccentric wheels 374 reciprocally displace the upper reaches of the documents away from the backing plate 320. Such displacement in combination with movement of the bottom portion of the documents 36 urges the documents towards a vertical position substantially parallel to the backing plate.

When a parallel orientation of the documents 36 has been achieved, as indicated by simultaneous activation of both the upper sensor 350 and the lower sensor 352, the controller 60 directs the third servo-motor control circuit 406 to activate the conical roller motor 307. This causes the conical rollers 304 to rotate, thus transporting the on-edge documents at right angles to the feed ramp 16 and towards other processing stations. At this point, the controller 60 directs the first servo-motor controller 402 to activate the conveyor belts 30 and directs the second servo-motor controller 404 to activate the paddle transport motor 94 so that the documents 36 are transported in the forward direction 42. During simultaneous activation of the conveyor belts 30 and the paddle transport belt 84, the forward paddle 72 moves in an indexed manner along with the conveyor belts 30. The above process is repeated so that the documents 36 are continuously processed and fed into the shingler device 302.

The controller 60 determines that the documents 36 are inclined at a backward angle relative to the backing plate 320 when the lower sensor 352 senses contact with the stack of documents 36 while the upper sensor 350 does not sense contact, as illustrated in FIG. 7B. To urge the documents 36 toward a substantially vertical position, the controller 60 stops the conveyor belts 30 so that the bottom of the documents 36 remain fixed relative to the feed ramp 16. The controller 60 then directs the second servo-motor control circuit 404 to activate the paddle transport motor 94 causing the paddle transport belt 84 to move the forward paddle 72 in the forward direction 42.

Movement of the forward paddle 72 urges the upper reaches of the first stack of documents 140 from an angled position toward a substantially vertical position. When the forward paddle 72 has moved forward a distance sufficient to vertically align the first stack of documents 140, the documents simultaneously contact the upper sensor 350 and the lower sensor 352. When such a parallel orientation of the first stack of documents 140 has been achieved, as indicated by simultaneous activation of both the upper sensor 350 and the lower sensor 352, the controller 60 directs the third servo-motor control circuit 406 to activate the conical roller motor 307. This causes the conical rollers 304 to rotate, thus transporting the on-edge documents at right angles to the feed ramp 16 and toward other processing stations. At this point, the controller 60 activates the conveyor belts 30 to move the documents 36 in the forward direction 42 as the forward paddle 72 moves in an indexed manner along with the conveyor belts driven by the paddle transport belt 84. The above process is repeated so that the documents 36 are continuously processed and fed into the shingler device 302.

When the upper sensor 350 and the lower sensor 352 substantially simultaneously sense contact with the first stack of documents 140, the stack of documents is substantially parallel to the face 322 of the backing plate 320, as illustrated in FIG. 7C. No adjustment need be performed and the controller 60 directs the conical rollers 304 to rotate by directing the third servo-motor controller 406 to activate the conical roller motor 307, thus transporting the on-edge documents at right angles to the feed ramp 16 and towards other processing stations. At this point, the controller 60 continues to cause the conveyor belts 30 and the forward paddle 72 to move the stack of documents 36 in the forward direction 42 as the forward paddle 72 moves in an indexed manner along with the conveyor belts. The above process is repeated so that the documents 36 are continuously processed.

A specific embodiment of an in-feed magazine apparatus and method for loading documents according to the present invention has been described for the purpose of illustrating the manner in which the invention may be made and used. It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

What is claimed is:

1. A loading apparatus for feeding stacks of documents towards a feed-roller mechanism, the stacks of documents extending successively from a front end to a back end, the documents having at least a bottom and a side boundary each defined by substantially coplanar marginal edges of the documents, the apparatus comprising:

a feed ramp having one or more document conveyor belts disposed along a bottom surface, said one or more conveyor belts adapted to engage the bottom boundary of the documents;

the one or more conveyor belts configured to effect forward movement of a first and a second stack of documents toward the feed-roller mechanism along a predetermined path, a face of each document generally parallel to the face of adjacent documents and transverse to a linear axis defined by the forward movement of the documents:

a forward paddle;

a rear paddle parallel to the forward paddle, each paddle having a planar face transverse to the linear axis and generally parallel to a face of the documents;

a controller operatively coupled to the one or more conveyor belts and to the forward and rear paddles to selectively and variably control the speed of the one or more conveyor belts and the forward and rear paddles;

a paddle transport mechanism operatively coupled to the forward paddle to effect forward motion of the forward paddle in selectable linear correspondence with forward motion of the one or more conveyor belts to urge and maintain the first stack of documents in a substantially vertical position relative to the one or more conveyor belts; and the rear paddle operatively coupled to the one or more conveyor belts to effect forward motion of the rear paddle in linear correspondence with the one or more conveyor belts such that the second stack of documents is bounded between the rear paddle and the forward paddle.

2. The apparatus of claim 1 wherein the forward paddle is rotatable about a second axis parallel to the second axis such that upward rotation of the forward paddle about the linear axis disengages the forward paddle from between the first and second stack of documents causing the second stack of documents to merge into the first stack of documents.

3. The apparatus of claim 2 wherein the forward paddle is selectively disengagable from the paddle transport mechanism and linearly displaceable along the second axis when in the upwardly rotated position, and the rear paddle is selectively disengagable from the one or more conveyor belts and linearly displaceable along the second axis.

4. The apparatus of claim 3 wherein disengagement of the forward paddle from between the first and second stacks of documents, subsequent rearward linear displacement of the forward paddle to a position adjacent and forward of the rear paddle, and subsequent rearward linear displacement of the rear paddle causes the second stack of documents to merge into the first stack of documents such that additional documents placed between the forward paddle and the rear paddle form the second stack of documents.

5. The apparatus of claim 1 wherein the forward paddle includes a gear mechanism in selective operative communication with the paddle transport mechanism configured to permit displacement of the forward paddle in the forward direction.

6. The apparatus according to claim 5 wherein the gear mechanism is in operative communication with the paddle transport mechanism when the forward paddle is in a downwardly rotated position and is disengaged from the paddle transport mechanism when the forward paddle is in an upwardly rotated position.

7. The apparatus of claim 6 wherein the gear mechanism includes a one-way clutch that allows the gear mechanism to rotate in a clockwise direction and does not allow rotation in a counter-clockwise direction to permit forward linear displacement of the forward paddle relative to the paddle transport mechanism when the forward paddle is in the downwardly rotated position.

8. The apparatus of claim 1 further including a spacer projecting from a front surface of the rear paddle to separate the second stack of documents from the rear paddle by a predetermined distance, and a channel disposed in the front paddle configured to engage the spacer during rotation of the forward paddle when the forward paddle is disposed in front of and adjacent to the rear paddle.

9. The apparatus of claim 8 wherein the channel in the forward paddle is curved forming a locus corresponding to an arc defined by rotation of the forward paddle about a second axis parallel to the linear axis such that the locus of the channel engages the spacer during rotation of the forward paddle about the second axis.

10. The apparatus of claim 9 wherein the spacer projects through a portion of the channel when the forward paddle is disposed in front of and adjacent to the rear paddle.

11. A method for feeding stacks of documents towards a feed-roller mechanism, the stacks of documents extending successively from a front end to a back end, the method comprising the steps of:

a) separating a forward and a rear paddle by a predetermined distance along a conveyor mechanism;

b) placing a first stack of documents on the conveyor mechanism ahead of the forward paddle;

c) placing a second stack of documents on the conveyor mechanism between the forward paddle and the rear paddle as the documents are transported in the forward direction toward the feed-roller mechanism;

d) transporting the first and second stacks of documents toward the feed-roller mechanism in a forward direction along a predetermined path, the forward and rear paddles moving in selectable linear correspondence with the documents, the first stack of documents being directed into the feed-roller mechanism, said transporting performed under control of a controller to selectively and variably control the speed of the conveyor mechanism and the forward and rear paddles;

e) upwardly rotating the forward paddle about a linear axis defined by the forward motion of the documents when a predetermined portion of the first stack of documents has been directed into the feed-roller mechanism, to disengage the forward paddle from between the first and second stacks of documents to cause the second stack of documents to merge into the first stack of documents;

f) rearwardly displacing the forward paddle to a position adjacent and forward of the rear paddle;

g) downwardly rotating the forward paddle such that the forward paddle is disposed between the rear paddle and the first stack of documents;

h) rearwardly displacing the rear paddle to form a gap of predetermined length between the forward and the rear paddle such that the forward paddle is adjacent the back end of the first stack of documents; and i) continuously repeating the steps (c) through (h).

12. The method according to claim 11 wherein the step of upwardly rotating the forward paddle disengages the paddle from a paddle transport mechanism to allow forward and rearward linear displacement of the forward paddle.

13. The method according to claim 11 wherein the step of downwardly rotating the forward paddle places the forward paddle in a position forward and adjacent the rear paddle and between the rear paddle and the first stack of documents such that the first stack of documents disposed adjacent the rear paddle are not displaced by the forward paddle.

* * * * *